United States Patent [19]

Noren

[11] 4,073,555

[45] Feb. 14, 1978

[54] DISHWASHER WITH DOWNWARDLY MOVABLE DOOR COUNTERBALANCED BY SPRING-BIASED TOGGLE JOINTS

[76] Inventor: Tore H. Noren, 3200 Lakeville Highway, Petaluma, Calif. 94952

[21] Appl. No.: 643,545

[22] Filed: Dec. 22, 1975

[51] Int. Cl.[2] ..... A47B 77/06; A47B 51/00

[52] U.S. Cl. ..... 312/229; 312/272; 312/272.5; 312/312; 134/58 DL

[58] Field of Search ..... 312/229, 272, 272.5, 312/319, 312; 134/58 DL, 57 DL, 200

[56] References Cited

U.S. PATENT DOCUMENTS

| | | | |
|---|---|---|---|
| Re. 27,558 | 1/1973 | Phelps et al. | 312/272 |
| 1,485,797 | 3/1924 | Merseles | 312/272.5 |
| 1,628,818 | 5/1927 | Zademack | 312/312 |
| 1,921,690 | 8/1933 | Miller | 312/272 |
| 2,455,154 | 11/1948 | Bailey | 312/272 |
| 2,463,256 | 3/1949 | Curtiss | 312/312 X |
| 2,614,020 | 10/1952 | Collins | 312/312 |
| 2,633,399 | 3/1953 | Haas | 312/312 X |
| 2,664,094 | 12/1953 | Spragins | 134/58 DL |
| 2,719,070 | 9/1955 | Haas | 312/312 |
| 2,790,690 | 4/1957 | James | 312/319 X |
| 3,190,711 | 6/1965 | Haas | 312/319 |
| 3,542,446 | 11/1970 | Jayce | 312/312 |
| 3,582,173 | 6/1971 | Noren | 312/229 |

*Primary Examiner*—Paul R. Gilliam
*Assistant Examiner*—Victor N. Sakran
*Attorney, Agent, or Firm*—William R. Piper

[57] ABSTRACT

A dishwasher having a tank containing wash water disposed below a dishwashing compartment and means for removing water from the tank and forcing it through upper and lower revolving spray arms for washing the dishes, the wash water being returned to the tank by gravity. A hood overlies the top of the wash and rinse compartment and a door for closing the compartment is movable downwardly into the tank for opening the compartment, the weight of the door being yieldingly held in closed or open position by spring biased toggle joints that are positioned in the tank. A U-shaped member is removably secured to the hood that overlies the dishwashing compartment and this member acts as a door stop when the door is in its raised and closed position. A removal of the member from the hood permits the door to be removed from the dishwasher.

3 Claims, 7 Drawing Figures

DISHWASHER WITH DOWNWARDLY MOVABLE DOOR COUNTERBALANCED BY SPRING-BIASED TOGGLE JOINTS

SUMMARY OF THE INVENTION

U.S. Pat. No. 3,582,173, issued June 1, 1971, of which applicant is one of the joint inventors, is directed to a drinking-glass or dishwasher with three-sided door movable downwardly into the tank to open washing and rinsing compartment. In the patent a counterweight for balancing the weight of the door is connected to the door by cables passed over pulleys and connected to the door. This took up space in the dishwashing compartment and thus reduced the available space for receiving the dish-carrying baskets.

An object of my invention is to provide a dishwasher in which the spring biased toggle joints for counterbalancing the weight of the door and for holding the door in either closed or open position are positioned in the wash water containing tank that underlies the wash and rinse compartment. In this arrangement a greater space is provided in the wash and rinse compartment because none of the compartment space is needed to contain the counterweight cables and pulleys which was necessary in U.S. Pat. No. 3,582,173.

A further object of my invention is to provide a three-sided door whose height is substantially equal to the depth of the tank that contains the wash water. At the top of one of the corners in the door I provide a handle that projects a slight distance above the door top so that it will extend above the top of the tank when the door is in open position. The handle may be readily grasped by the operator when it is desired to close the door. When the door is closed the handle will be spaced a slight distance from the adjacent corner of the hood that overlies the dishwashing compartment and this permits the upper edge of the door to contact with the lower edge of the hood to make a liquid tight joining and yet the handle can be readily grasped for opening the door by moving the handle downwardly. Novel means is used for permitting the door to be removed from the dishwasher for inspection or repair.

BRIEF DESCRIPTION OF THE DRAWINGS

FIG. 5 is an enlarged and exploded isometric view illustrating the various parts making up one of the spring biased toggle joints that counterbalances the weight of the door so that the door will remain in any position into which it is moved within the limits of travel of the door.

DESCRIPTION OF PREFERRED EMBODIMENT

Figures 1, 2:
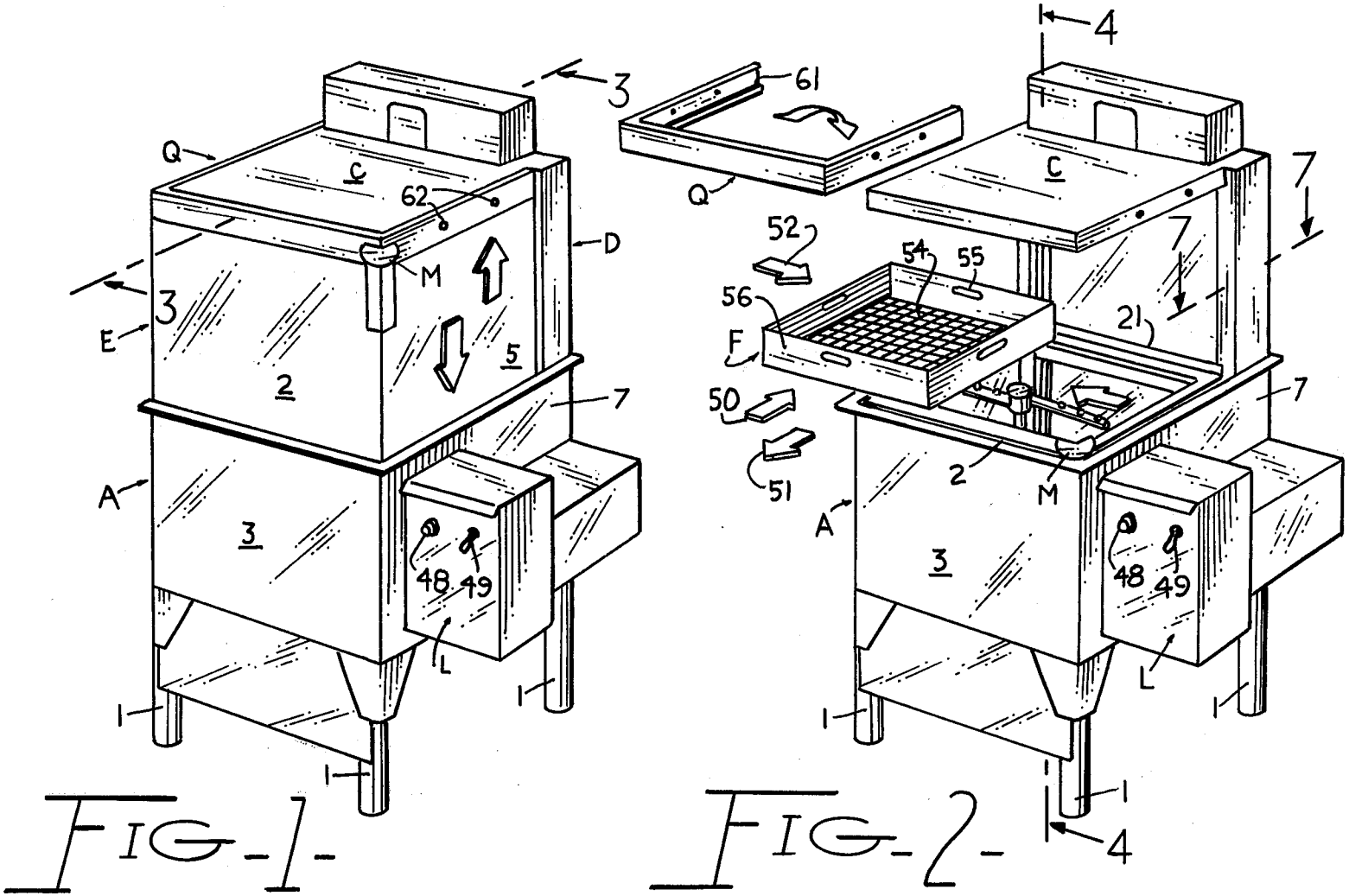
FIG. 1 is an isometric view of the dishwasher showing the door in closed position.
FIG. 2 is an isometric view similar to FIG. 1, but shows the door in open position and a dish-carrying basket is being moved into the washing and rinsing compartment.

In carrying out my invention I show a complete dishwasher in FIGS. 1 and 2. The dishwasher has a tank A for holding hot wash water for washing the dishes in a single wash and rinse compartment B that is disposed directly above the tank A. The wash water holding tank A is supported by legs 1. The lower part of the compartment B opens into the top of the tank A. A hood C covers the top of the compartment B and a hood support D has its lower portion forming the rear wall of the tank and its upper portion extends above the tank, see FIGS. 3 and 4, to the hood.

Figure 3:
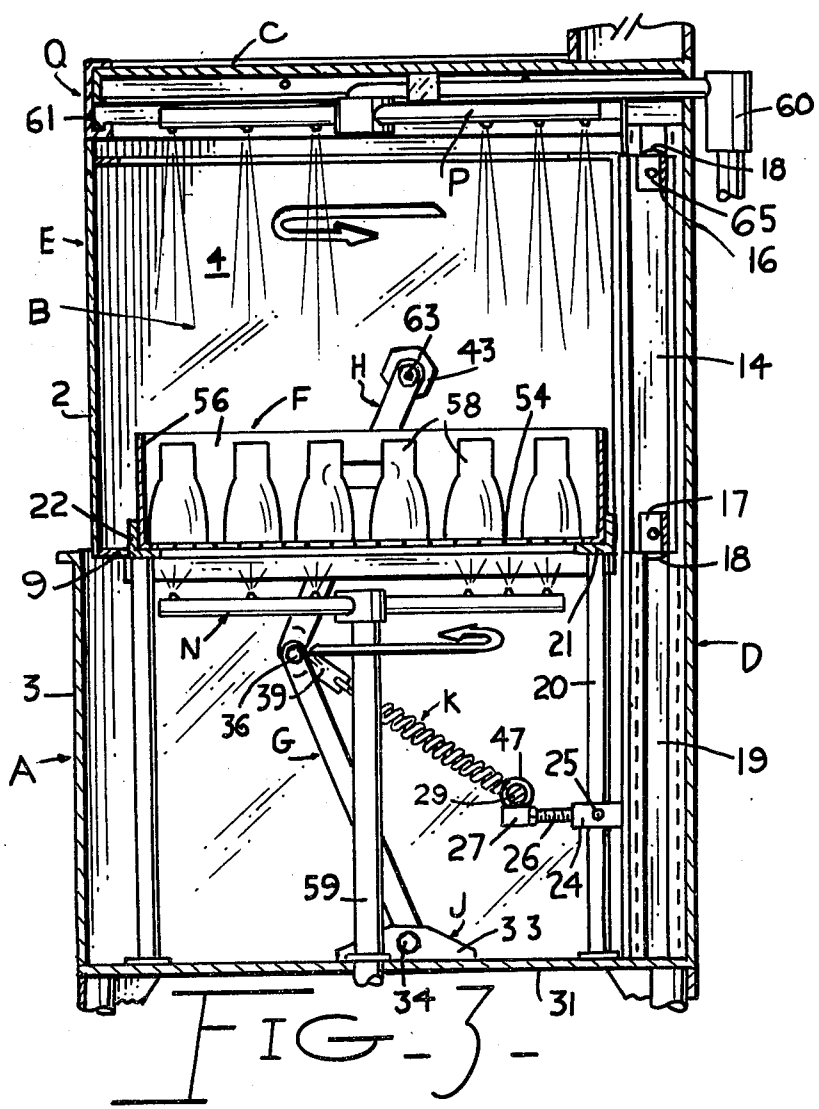
FIG. 3 is an enlarged vertical transverse section through the dishwasher and is taken along the line 3—3 of FIG. 1. This Figure shows the door in closed position.
Figure 3:
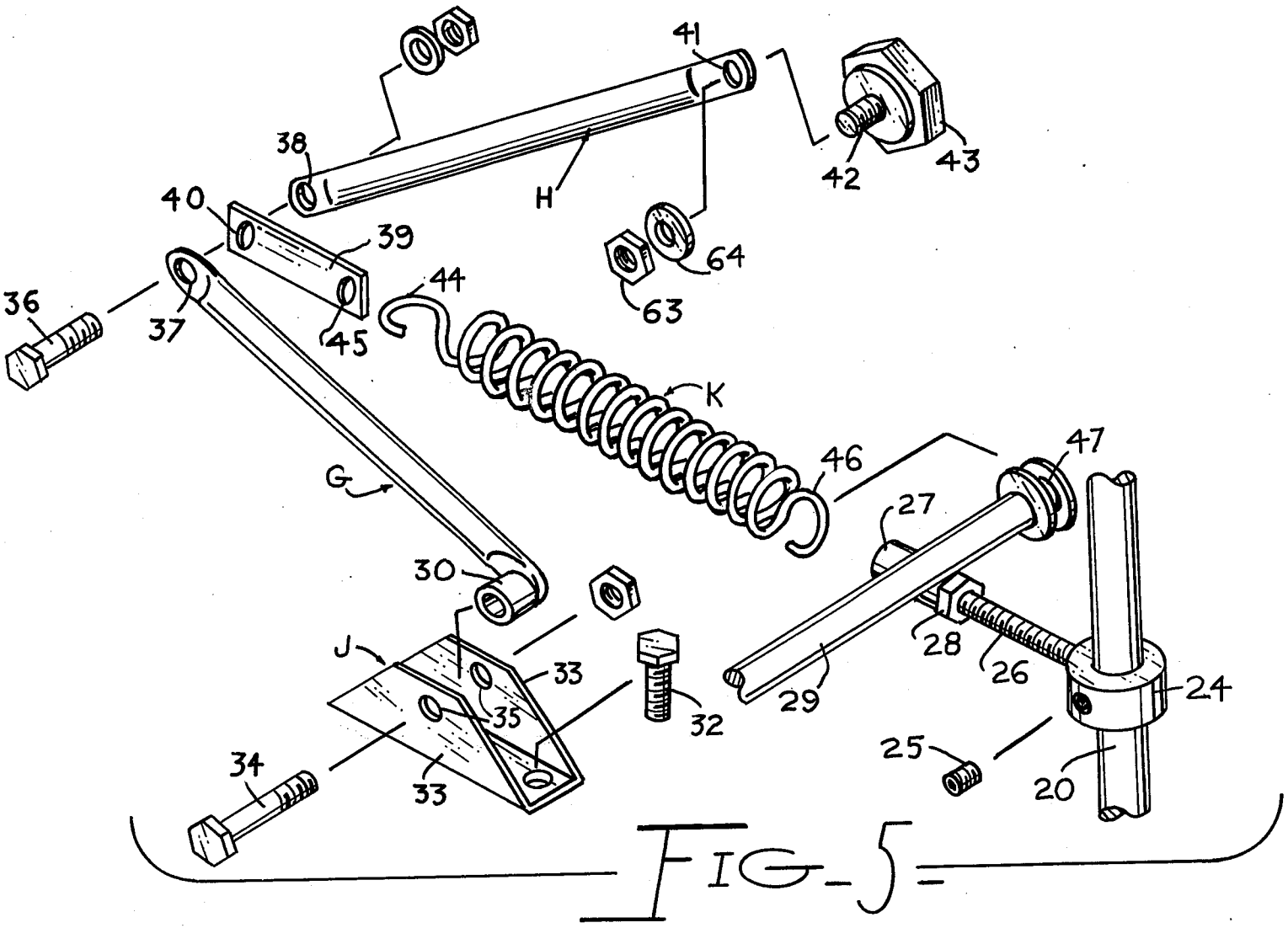
Figure 6:
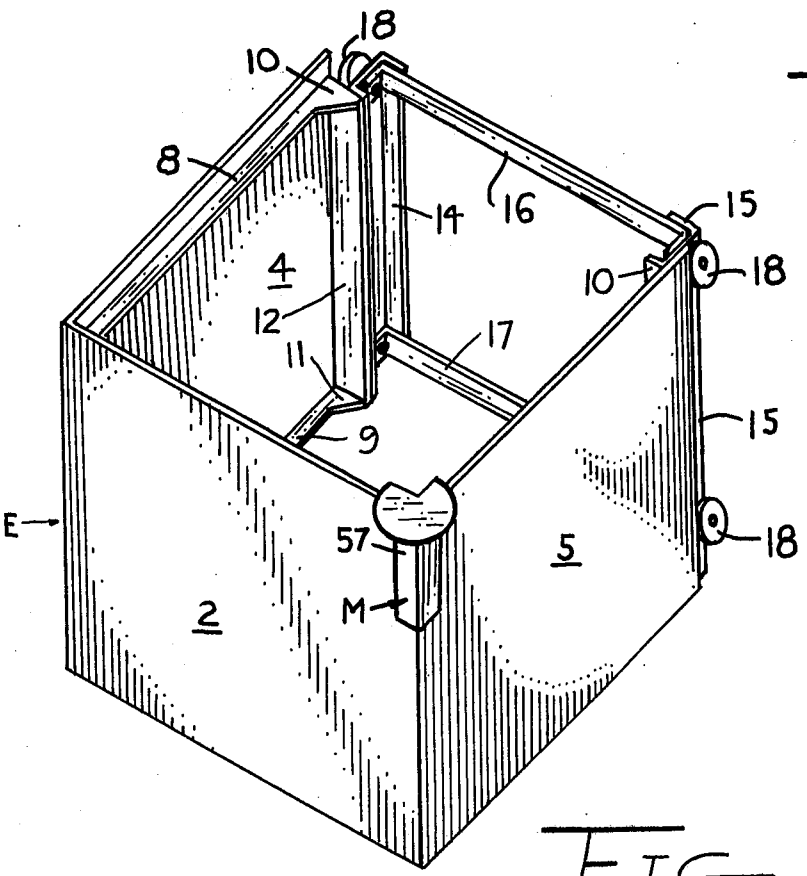
FIG. 6 is an isometric view of the three-sided door.

A three-sided door E has a front panel 2 that parallels the front wall 3 of the wash water holding tank A when the door is received within the tank as shown in FIG. 3. The door is in open position when it is disposed within the tank. FIG. 6 shows an isometric view of the three-sided door E and illustrates its two side panels 4 and 5. These side door panels 4 and 5 parallel the adjacent side walls 6 and 7, respectively, of the tank, see FIGS. 3 and 7, when the door is received within the tank and is in open position.

Figure 7:
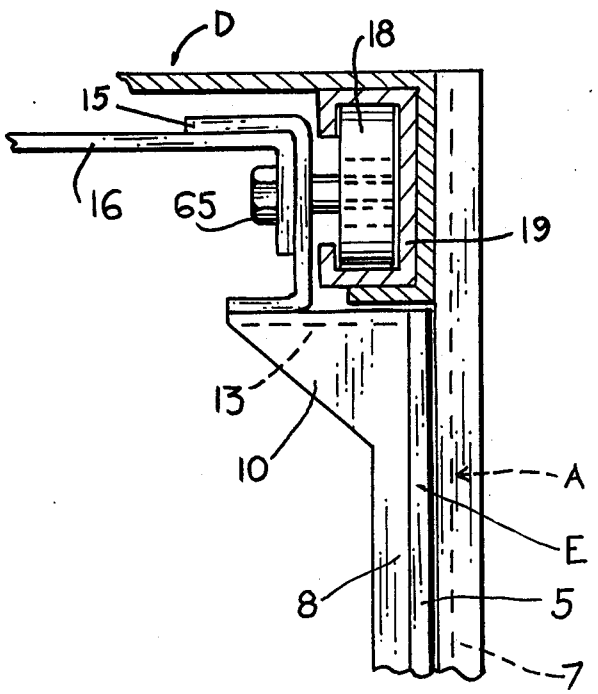
FIG. 7 is an enlarged horizontal section taken along the line 7—7 of FIG. 2 and illustrates one of the vertical channel guides and rollers for permitting the vertical movement of the door from closed to open position and vice versa.

The particular structure of the door E is shown in enlarged detail in the isometric view of FIG. 6 and in the horizontal sectional view of FIG. 7, which shows how the door is guided in its vertical movement in the dishwashing machine. The three-sided door has an open back and the three walls 2, 4 and 5 are reinforced by an upper U-shaped horizontal brace 8, see FIGS. 4 and 6, and a similar U-shaped lower horizontal brace 9, see FIGS. 3, 4 and 6. These braces may be welded or otherwise secured to the inner surfacs of the three walls 2, 4 and 5 of the door E. It should be noted from FIG. 6 that the free ends of both U-shaped braces 8 and 9, have triangularly shaped inwardly extending projections 10 and 11, respectively, that are interconnected by vertical members 12 and 13, see also FIG. 7.

Inwardly facing and vertically extending channels 14 and 15 have one of their sides welded or otherwise secured to the vertical members 12 and 13, respectively, see FIGS. 6 and 7. Upper and lower straps 16 and 17 extend transversely across the open rear of the three-sided door E and have their ends bent at right angles and secured to the channels 14 and 15. A pair of door guiding rollers 18 are rotatably connected to each of the vertical channels 14 and 15, see FIG. 6, and one of these rollers is shown in FIG. 7 as riding in a vertical guide channel 19. Two of these roller guide channels 19 are used in the dishwashing machine and they are secured to the sides of the combination back and support D for the hood C. The horizontal enlarged section of a portion of the back D illustrates how each side of the back D is bent for providing a channel-shaped reinforcement for the back as well as receiving the roller guide channels 19.

Figure 4:
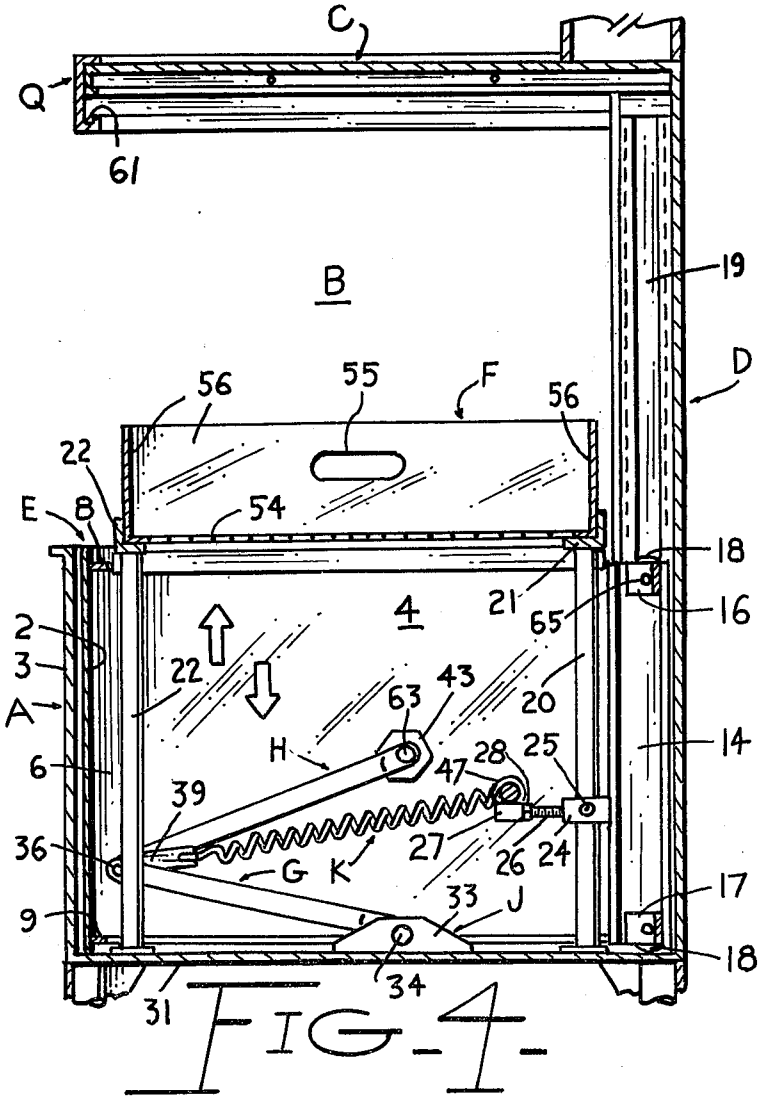
FIG. 4 is an view similar to FIG. 3 and is taken along the line 4—4 of FIG. 2 to show the door in open position and received within the tank.

I will now describe the pair of spring biased toggle joints that counterbalance the weight of the door E so as to support the door in any position into which it is moved and to hold the door in that position. In FIGS. 3, 4 and 5, I illustrate one of the toggle joints and since both are identical to each other, the detailed description of one will suffice for both. I mount a pair of uprights 20-20 at the rear of the dish water holding tank A. The rear uprights 20 support a dish-carrying basket angle iron 21 at their tops, see also FIG. 2. Another pair of uprights 22 are mounted adjacent to the front of the tank A and these support another angle iron 23 that parallels the angle iron 21. These angle irons 21 and 23 removably support a dish-carrying basket F, shown in FIGS. 2, 3 and 4. The basket is of standard construction and will be described more in detail later on in this specification.

One of the rear uprights 20 is shown on an enlarged scale in the exploded isometric view shown in FIG. 5. The upright has a sleeve 24 adjustably mounted thereon and held in place by a set screw 25. A threaded rod 26 has one end received in a threaded bore, not shown, in the sleeve 24. A tubular member 27 has a nut 28 welded to it at one end and this nut receives the free end of the threaded rod 26. Each rear upright 20 carries the adjustable tubular member 27 and a cross piece 29 is welded to the two members 27. The cross piece 29 can be moved toward or away from the uprights 20 by rotating the threaded rods 26 in the nuts 28 and in the threaded bores, not shown, in the sleeves 24. The purpose of this adjustment of the cross piece 29 will be set forth hereinafter.

Each toggle joint comprises two arms G and H, see FIGS. 3, 4 and 5. The lower arm G has an integral sleeve 30 at its right hand end, see the exploded view in FIG. 5, whose axis extends at right angles to the longitudinal axis of the arm. A bracket J is secured to the bottom 31 of the wash tank A by studs 32, see FIG. 5. The bracket J has parallel upstanding sides 33–33 and the arm G with its sleeve 30 is received between the sides of the bracket. A bolt 34 is passed through aligned openings 35 in the bracket J and through the sleeve 30 for pivotally connecting the lower toggle arm G to the bracket.

The free end of the lower toggle arm G is pivotally connected to the adjacent end of the upper toggle arm H by a bolt 36 that is passed through aligned openings 37 in the toggle arm G, and the opening 38 in the toggle arm H, see FIG. 5. A link 39 is placed between the two arms G and H, and it has an opening 40 for receiving the bolt 36. The free end of the upper toggle arm H has an opening 41 for receiving a bolt 42 whose enlarged head 43 is welded or otherwise secured to the inner surface of the side panel 4 of the door E. A tension coil spring K has one end 44 passed through an opening 45 in the free end of the link 39 and has its other end 46 passed around a grooved collar 47 which is mounted at the end of the cross piece 29. All of the parts making up the spring biased toggle joint are shown assembled in FIGS. 3 and 4. When the vertically movable door E is in closed position, as shown in FIG. 3, the two toggle arms G and H are extended in the manner shown in FIG. 4, the two toggle arms G and H are swung so as to make an acute angle with respect to each other.

OPERATION

From the foregoing description of the various parts of the device, the operation thereof will be readily understood. In FIGS. 1 and 2, I show the dishwasher control unit L with control switches 48 and 49. When the starting switch 48 is depressed, the control unit L will cause the dishwasher to wash, rinse and sterilize the dishes in the manner set forth in U.S. Pat. No. 3,903,909 issued on Sept. 9, 1975, to Tore H. Noren and George J. Federighi for an apparatus for washing, rinsing and sterilizing the dishes, of which I was one of the joint inventors. The present dishwashing machine pertains primarily to the spring biased toggle that counterbalance the weight of the door E and hold it in either closed or open position and at any position therebetween.

When the door E is in open position as illustrated in FIG. 2, the wash and rinse compartment B is open at the front and on both sides. The basket F may be inserted into the compartment from the front as indicated by the arrow 50 or withdrawn through the front as indicated by the arrow 51. The basket will rest on the angle irons 21 and 23 when received in the compartment, see FIGS. 3 and 4. The arrow 52 in FIG. 2 shows how the basket F may be moved into the open compartment B from the left hand side of the machine while the arrow 53 in the same Figure illustrates how the basket may be moved into the compartment from the right hand side. The basket F is of standard construction and has a wire mesh bottom 54 and hand openings 55 in its four side walls 56.

When the door E is in open position and is received within the wash tank A, the top edges of the door lie substantially flush with the top edges of the tank, see FIG. 4. This necessitates the provision of a door handle M that will extend above the top of the door so that this handle may be grasped for moving the door when it is in open position and the operator wishes to close the door. FIGS. 1, 2 and 6 illustrate the handle M as having a shank 57, angle-shaped in cross section and welded to the right hand corner of the door so that the top of the handle will project above the door top. The top of the handle is also of angular shape so as to override the right hand front corner of the hood C when the door E is closed, see FIG. 1.

The operator can place a basket of soiled dishes, such as the glasses shown at 58 in FIG. 2, within the compartment B and then close the door E by lifting it into the closed position shown in FIG. 1. The coil springs K of the toggle joints have been properly tensioned by adjusting the threaded rods 26 so as to cause the spring biased toggle joints to counterbalance the weight of the door. It will be noted from FIG. 3 that when the door E is closed, the toggle arms G and H will make an obtuse angle with respect to each other and therefore there is less force required to hold the door in closed position because the two toggle arms are close to lying in a common straight line between the pivot points 34 and 42. The spring K is contracted and exerts less pulling force on the pivot 36 interconnecting the two toggle arms and yet this force is sufficient to counterbalance the weight of the door and hold it in closed position. FIG. 4 shows the door E in open position and the two toggle arms make an acute angle with respect to each other. It requires a greater pulling force by the spring K to counterbalance the weight of the door because of this acute angle between the toggle arms. FIG. 4 shows the tension spring K greatly extended and therefore it will exert far more pulling force on the pivot 36 that interconnects the two arms with the result that again the spring biased toggle arms G and H will effectively counterbalance the door while permitting it to remain in open position. The collars 25 can be adjusted on the rear uprights 20 and the threaded rods 26 can also be adjusted to correctly balance the weight of the door regardless of its position. The collars 47 therefore become vertically and horizontally adjustable anchors for the springs K.

The switch 49 is closed and will start a motor, not shown, for operating a pump, not shown, for removing hot wash water from the tank A and forcing it through pipes 59 and 60 to the lower and upper revolving spray arms N and P, respectively, as shown in FIG. 3. The hot water has previously been added to the wash tank with the proper amount of detergent. The wash water issuing from the revolving spray arms N and P will be directed against the dishes from the bottom as well as the top. This wash water will drop into the tank A and be reused so long as the washing operation continues.

The control unit L houses a timing mechanism that will keep the washing operation functioning until the dishes are thoroughly washed at which time the washing operation will automatically be followed, by the rinsing and sterilizing operation. When this is completed the control unit L will automatically stop the dishwashing machine from operating. Since the washing and rinsing cycles of the dishwasher form no part of the present invention, further detailed description of this part of the dishwasher is not necessary.

I provide novel means for permitting the three sided door E to be removed entirely from the dishwasher if needed for repair or inspection. In FIG. 1, I show the hood C with the U-shaped member Q extending across the front and along the two sides of the hood while in FIG. 2, I show the member removed from the hood. The member Q is channel-shaped in cross section as is clearly illustrated in FIGS. 2, 3 and 4. The top of the door E, when in closed position, abuts the lower portion of the U-shaped member Q, as shown in FIG. 3. Also it will be seen from FIG. 4 as well as from FIG. 3 that the lower portion of the member Q has an upwardly facing trough 61 for receiving any water splashing into it and this water will be carried to the ends of the U-shaped trough and returned to the compartment B.

When it is desired to remove the door E from the dishwasher for inspection or repair, the screws 62, see FIG. 1, that secure the U-shaped member Q to the hood C are removed and this will permit the removal of the member Q from the hood as indicated in FIG. 2. When this is done the nut 63, see FIG. 5, and washer 64 may be removed from the bolt 42 on each side wall of the door E for freeing the upper toggle arm H from each side of the door. Next the bolts 65, see FIG. 7, that carry the door guide rollers 18 are removed for freeing the rollers from the door. Now the door E may be lifed and the top of the door will pass the front and two sides of the hood E because the U-shaped member Q has been removed and when the lower end of the door clears the top of the tank A, the door is free to be entirely removed from the dishwasher. The reverse procedure is followed when placing the door back into the dishwasher and reattaching it to the upper toggle arms H.

The manner of adjusting the exact positions of the grooved cellars 47 broadly termed adjustable anchors for the rear end of each spring K, it is very important because no two doors E weigh exactly the same. Therefore in order to properly balance each door by the spring biased toggle joints, it is necessary to move the sleeves 24 on the rear uprights 20 to the correct vertical position of the collars 47 and also to adjust the threaded rods 26 in the nuts 28 and tubular members 27 for moving the members 27, cross piece 29 and collars 47 for moving the latter in order to create the proper tension on the springs K. By this manner of adjustment, the spring-biased toggles can properly balance the weight of the door E to which they are attached. In fact, the adjustment of the angle and tension on the springs K is such that when the door is closed the springs will still urge the toggles to create an upward thrust against the door for yieldingly holding the top of the door in contact with the underside of the U-shaped member Q which is secured to the hood C. Also when the door is closed, the springs will exert a yielding tension on the toggle joints for yieldingly holding the door against the bottom of the tank A, see FIGS. 3 and 4. The top of the corner handle M projects above the tank top when the door E is open, see FIG. 2, and the handle clears the U-shaped member Q when the door is closed, see FIG. 1. In each instance the handle M can be grasped for readily moving the door.

I claim:

1. A dishwashing machine comprising:

a. a tank for holding water for washing dishes;

b. a dish basket receiving compartment disposed above said tank;

c. a hood covering the top area of the compartment and supported by a back that also forms a wall of said tank;

d. a door movable vertically from a top position where it cooperates with said back and said hood for closing the compartment, to a bottom position where it is received in said tank and permits access into and out of the compartment;

e. spring biasd toggles connected to said door and said tank for counterbalancing said door for supporting it at all elevations from closed to open position, said spring biased toggles including a pair of toggles arranged at opposite sides of said tank, each toggle comprising a lower toggle arm having one end pivotally mounted at the bottom of said tank and adjacent to the vertically movable door, an upper toggle arm having one end attached to the pivotal connection between the two arms and its other end connected to an anchor collar that has means for adjusting its vertical and horizontal position for altering the tension and angle said spring makes relative to the pivotal connection between the two toggle arms;

f. said means for adjusting the vertical and horizontal position of said anchor collars includes an upright mounted in said tank for each anchor collar;

g. a sleeve adjustable vertically on each upright;

h. a threaded rod extending radially from each sleeve and supported thereby;

i. a tubular member for each threaded rod and having a threaded connection therewith;

j. a cross piece interconnecting the two tubular members and supporting said anchor collars; and k. whereby said anchor collars can be moved into the correct position both vertically and horizontally by adjusting said sleeves on said uprights and adjusting said threaded rods for moving said tubular members so as to apply the proper tension and angle on said springs to substantially counterbalance the weight of said door.

2. The combination as set forth in claim 1: and in which a. said doors being three sided and having a pair of guide rollers at each side thereof and adjacent to the open rear thereof;

b. said back supporting vertical guide channels, one for each pair of door guiding rollers, said rollers moving freely in said channels during any vertical movement of said door;

c. said hood having its front and two parallel sides spacd inwardly a distance just sufficient to permit the top of the door to clear the hood in its upward movement when it is desired to remove said door from said dishwasher, the guide rollers being disconnected from said door for this purpose;

d. a U-shaped member having a front designed to abut the front of said hood when the member is secured to said hood and having spaced parallel sides designed to abut the two sides of said hood for enlarging the overall area of said hood, the underside of said U-shaped member lying below the underside of said hood and lying in the path of the vertically movable door; and e. whereby an upward movement of the door into closed position will cause the top of the door to contact the underside of said U-shaped member for closing the compartment.

3. The combination as set forth in claim 1, and in which a. each toggle having its two arms making an acute angle with respect to each other when said cover is in its lowermost and open positon, the adjustable anchoring means for said spring being positioned so that the length of each spring substantially bisects the acute angle formed by the adjacent pair of toggle arms, the anchoring means causing the springs to exert a pull at the pivotal connection between the two arms of each pair of toggles for swinging the arms from an acute angle to a obtuse angle as they move the door from a bottom "open" position to a top "closed" position, the springs being stretched to a greater extent and exerting a greater pulling force and at the proper angle on the pivotal connection between the arms of each pair when they make an acute angle with respect to each other than when they make an obtuse angle.

* * * * *